US007815185B2

(12) United States Patent
Claris et al.

(10) Patent No.: US 7,815,185 B2
(45) Date of Patent: Oct. 19, 2010

(54) DEVICE FOR OPTIMALLY SELECTING MAILPIECES

(75) Inventors: Yannick Claris, Fontenay aux Roses (FR); Francis Coret, Gournay sur Marne (FR)

(73) Assignee: NEOPOST Technologies, Bagneux (FR)

( * ) Notice: Subject to any disclaimer, the term of this patent is extended or adjusted under 35 U.S.C. 154(b) by 105 days.

(21) Appl. No.: 12/354,492

(22) Filed: Jan. 15, 2009

(65) Prior Publication Data

US 2009/0189335 A1 Jul. 30, 2009

(30) Foreign Application Priority Data

Jan. 30, 2008 (FR) ..... 08 50569

(51) Int. Cl.
*B65H 3/56* (2006.01)

(52) U.S. Cl. ..... 271/121

(58) Field of Classification Search ..... 271/121, 271/124, 126
See application file for complete search history.

(56) References Cited

U.S. PATENT DOCUMENTS 3,869,116 A * 3/1975 Kroeker ..... 271/126
4,113,245 A * 9/1978 Colglazier et al. ..... 271/121
4,526,358 A * 7/1985 Ura et al. ..... 271/124
5,052,676 A * 10/1991 Shiina et al. ..... 271/121
5,453,852 A * 9/1995 Morikawa et al. ..... 271/121
5,576,823 A * 11/1996 Kakuta et al. ..... 271/126
5,946,996 A 9/1999 Oussani, Jr. et al.
5,951,002 A * 9/1999 Yokota ..... 271/121

FOREIGN PATENT DOCUMENTS

EP 0 195 348 A1 9/1986
EP 0 856 483 A1 8/1998

* cited by examiner

*Primary Examiner*—Gene Crawford
*Assistant Examiner*—Gerald W McClain
(74) *Attorney, Agent, or Firm*—Sughrue Mion, PLLC

(57) ABSTRACT

A mailpiece selector device for separating mailpieces one-by-one from a stack of mailpieces and for transporting them downstream. The mailpiece selector device includes a first guide cooperating with a plurality of opposite selector rollers to select the mailpieces one-by-one and for transporting them downstream. The first guide is able to pivot about a pivot axis in opposition to first resilient return and the first guide has a reference plate designed to cooperate with a magnet that is secured to a framework of the device to prevent the first guide from pivoting in this way below a predetermined mailpiece thickness.

5 Claims, 1 Drawing Sheet

FIG.1
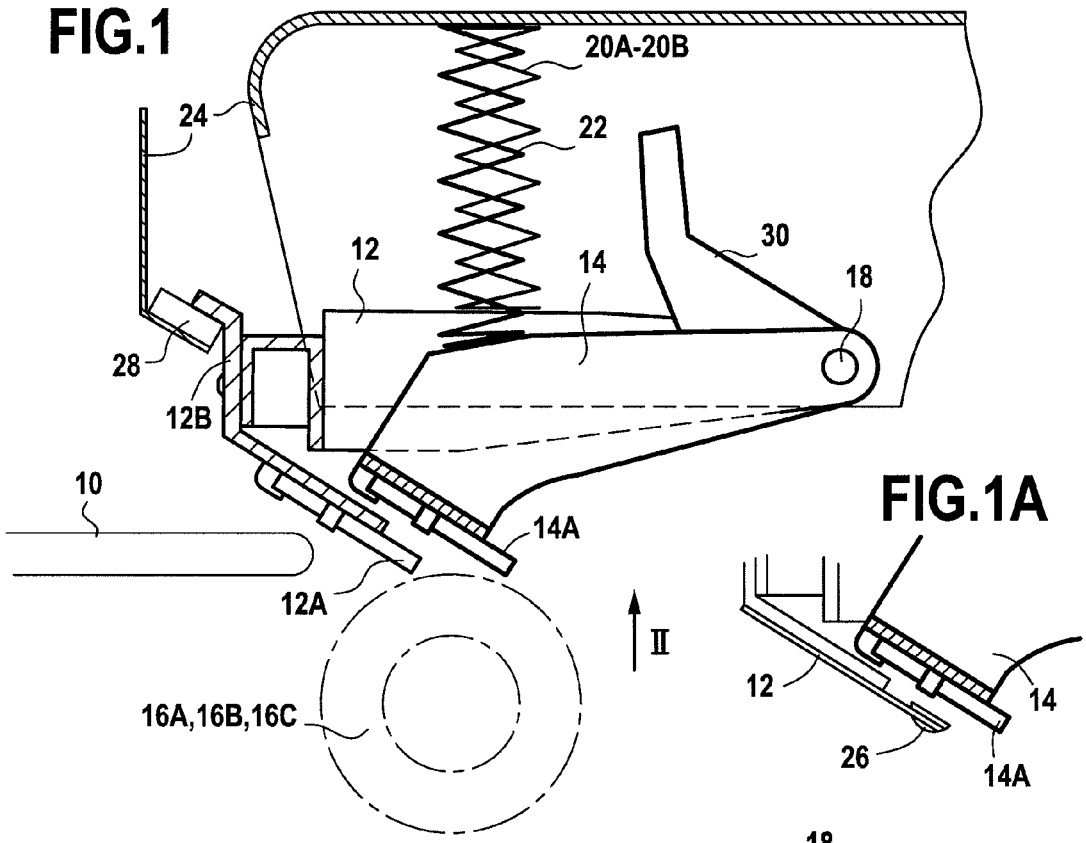
FIG.1A
FIG.2
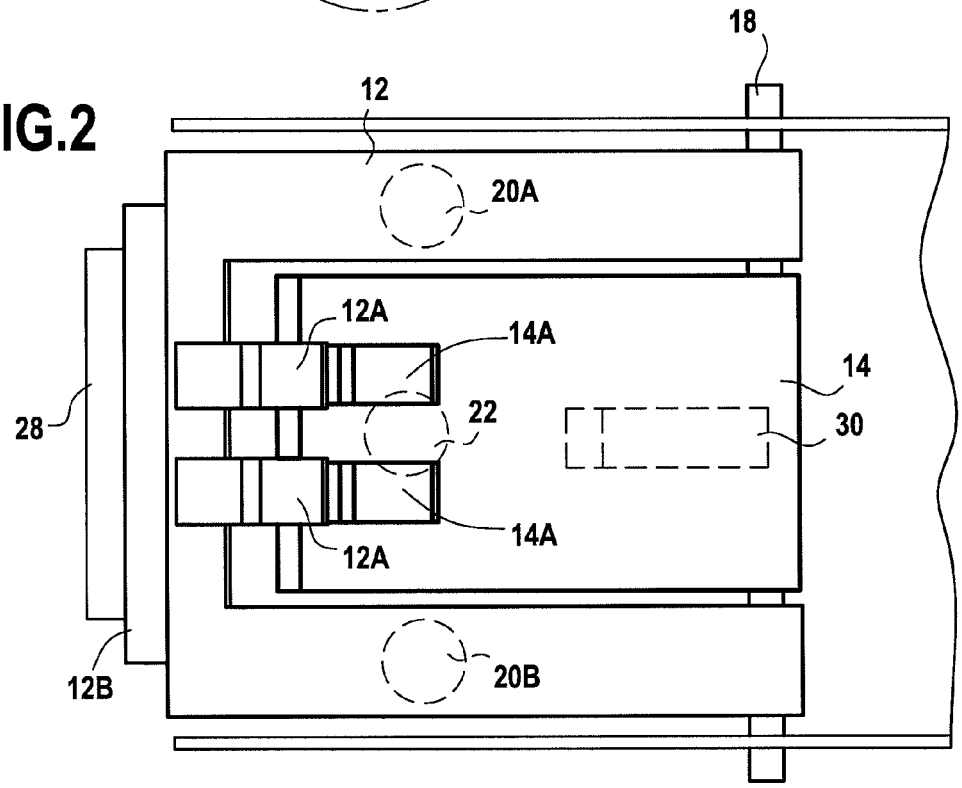

DEVICE FOR OPTIMALLY SELECTING MAILPIECES

This application claims priority from French Patent Application No. 0850569, filed Jan. 30, 2008, the entire disclosure incorporated herein by reference.

TECHNICAL FIELD

The present invention relates to the field of mail handling, and it relates more particularly to a device for selecting mailpieces that is implemented in an automatic feed module or "feeder" of a franking machine or "postage meter" for franking mailpieces.

PRIOR ART

Conventionally, a franking machine must be adapted to receive various types of mailpiece, such as documents, letters, or envelopes of greater or lesser thickness, typically lying in the range 0.1 millimeters (mm) to 16 mm. To this end, on the upstream side, it often includes an automatic feed module making it possible, in particular, to convey said mailpieces at various speeds. That automatic feed module usually includes means for receiving/stacking, selecting, transporting, and possibly closing said mailpieces.

European Patent EP 0 856 483, granted to the Applicant, shows an example of such an automatic feeder including a selector module adapted to passing mailpieces of various thicknesses, however the selection quality of that module is highly dependent on the force applied by the single guide to the mailpiece. For mailpieces of small thickness, typically of thickness less than 6 mm, that force must be large in order to limit the number of double passes, i.e. the number of times two envelopes pass through together towards the franking machine, whereas said force can be small for mailpieces of larger thickness. Such double passes are highly detrimental because they give rise not only to one of the two mailpieces being over-invoiced (because two mailpieces are weighed instead of one), but also to the upper mailpiece not being franked and to the lower mailpiece not being closed. Unfortunately, since the guide is pressed against the mailpiece by a compression spring in order to avoid such double passes, mailpieces of large thickness, and more particularly large-thickness mailpieces having windows, might be damaged or torn.

OBJECT AND DEFINITION OF THE INVENTION

An object of the present invention is to mitigate the drawbacks resulting from two envelopes passing through together by proposing a mailpiece selector device for a franking machine feeder that can limit such double passes to at the most 1 in 1000.

This object is achieved by a mailpiece selector device for separating mailpieces one-by-one from a stack of mailpieces and for transporting them downstream, wherein said mailpiece selector device comprises a first guide co-operating with a plurality of opposite selector rollers to select said mailpieces one-by-one and for transporting them downstream, said first guide being able to pivot about a pivot axis in opposition to first resilient return means and said first guide having a reference plate designed to co-operate with a magnet that is secured to a framework of the device to prevent said first guide from pivoting in this way below a predetermined mailpiece thickness.

By means of this specific structure and because of the presence of the magnet, a high pressing force is obtained by the first guide for envelopes of small thickness, typically of thickness less than 2 mm, and, depending on the return force of the spring, a mean pressing force is obtained by the first guide for envelopes of standard thickness. The quality of selection of thin envelopes is thus greatly improved.

Said first guide has a comb structure with each of the teeth thereof being provided with an elastomer blade or with a ceramic finger, depending on the embodiment.

The selector device may further comprise a second guide mounted to pivot about said pivot axis in opposition to second resilient return means secured to said framework of the device.

Advantageously, said second guide is provided with an operating lever for enabling an operator to act manually to clear the mailpiece transport path while mailpieces of large thickness, typically of thickness greater than 6 mm, are being processed.

This second guide further improves selection of mailpieces of small or standard thickness (up to 6 mm) by making it possible to catch any mailpieces that might nevertheless have passed through together with another mailpiece.

The present invention also relates to a mailpiece feeder for a franking machine, which feeder includes the above-mentioned mailpiece selector device.

BRIEF DESCRIPTION OF THE DRAWING

Other characteristics and advantages of the present invention appear more clearly from the following description given by way of non-limiting indication and with reference to the accompanying drawing, in which:

FIG. 1 is a longitudinal section view of a mailpiece selector device of the invention;

FIG. 1A shows a variant embodiment of the first guide; and

FIG. 2 is a plan view of the selector device of FIG. 1.

DETAILED DESCRIPTION OF A PREFERRED EMBODIMENT OF THE INVENTION

An automatic mailpiece feed module conventionally has a feed zone formed essentially by a deck designed to receive a stack of mailpieces and including first transport rollers for driving the mailpieces downstream (and against a referencing wall) at a separation zone having a separator device in which the mailpieces are extracted one by one from the stack of mailpieces. Second transport rollers are, in general, provided at the outlet of said separation zone for the purpose of conveying the mailpieces extracted in this way downstream. Such an automatic feeder is, for example, illustrated in the European patent cited in the introduction to the present application.

FIGS. 1 and 2 show, more precisely, the structure of the mailpiece separator device 10 of the invention, which device essentially comprises a first guide 12 followed by a second guide 14 opposing which a plurality of selector rollers, e.g. 16A, 16B, 16C, are mounted for selecting a single mailpiece only and for transporting it downstream. Both of the guides of the selector device are hinged about a common pivot axis and can pivot against or in opposition to first and second resilient return means 20A, 20B; 22, e.g. compression springs or traction springs, depending on the configuration adopted, in abutment against the framework 24 of the selector device, the pivoting taking place as the mailpieces pass over the selector rollers.

As is known, the first guide 12 is not disposed perpendicularly to the transport path of the mailpieces, but rather it is inclined downstream by about 45°. It is comb-shaped, each tooth being disposed between two adjacent rollers and each of its teeth (of which there are two in the example shown) has a blade 12A made of elastomer fastened to it that has a very high coefficient of friction in order to guarantee the best possible contact with the mailpiece.

In a variant embodiment shown in FIG. 1A, the elastomer blade 12A is replaced with a ceramic finger 26 that, compared with an elastomer blade, offers the advantage of not wearing and of not leaving marks on the mailpieces. Although an elastomer blade offers high performance, it wears relatively rapidly and might cause the more fragile of the mailpieces to be damaged by being creased or by jamming.

In accordance with the invention, said first guide is extended at its end further from the contact parts by a reference plate 12B designed to co-operate with a magnet 28 to which it remains "stuck" while mailpieces of small thickness, typically of thickness up to 2 mm, are being processed.

The second guide 14 has a comb structure that is identical to the structure of the first guide, with an elastomer blade 14A mounted on each of its teeth (of which there are also two in the example shown). However, rather than having an extension, it has an operating lever 30 for enabling an operator to act manually to clear the path for transporting the mailpieces, while mailpieces of large thickness are being processed, typically of thickness greater than 6 mm and less than 16 mm (conventionally the maximum threshold for selection). Without this retraction possibility, the elastomer blade might wear more rapidly and damage such thick envelopes (e.g. by creasing windowed envelopes or by causing a jam) even though such envelopes can be selected in entirely satisfactory manner by the first guide alone, without any risk of two of them passing through together.

The selector device of the invention operates as follows. In order to avoid creasing the mailpieces that are fragile, the mailpieces to be processed are preferably pre-sorted by placing in a first batch those mailpieces that are of small or standard thickness, i.e. typically of thickness less than 6 mm, and that are to be processed both by the first guide 12 and by the second guide 14, and by placing in a second batch those mailpieces that are of large thickness and that are to be processed by the first guide 12 only, the second guide 14 being raised manually via its operating lever 30.

However, it should be noted that such pre-sorting is not essential and the operator can choose to process all types of mailpieces without acting on the manual operating lever.

While the first batch is being processed, the stiffness necessary for selecting mailpieces of small thickness (less than 2 mm) is generated by the magnet 28 that thus remains stuck to its reference. The first guide does most of the selection work, and the second guide catches any double passes, if necessary. For standard mail, i.e. for mailpieces of thickness lying in the range 2 mm to 6 mm, the mailpiece coming into contact with the guide overcomes the force with which the magnet is held, and the pressing force exerted by the first guide is then achieved solely by the action of the return spring 20A, 20B, the second guide catching any double passes, if necessary and as above.

For processing the second batch, the second guide is raised, thereby avoiding premature wear thereof, the mailpieces being selected solely by the first guide under the action of the return spring 20A, 20B.

Thus, with the present invention, it is possible to process various thicknesses of envelope without damaging the envelopes because the selector device is very stiff for the thin envelopes and loses its stiffness for the thicker standard envelopes, for which the pressing force resulting from a return spring suffices to select them without giving rise to double passes. Beyond this threshold, i.e. for envelopes that are even thicker, for which the problem of double passes does not exist in practice, the action of the spring suffices to select said envelopes, regardless of whether or not the second guide is active.

What is claimed is:

1. A mailpiece selector device for separating mailpieces one-by-one from a stack of mailpieces and for transporting them downstream, wherein said mailpiece selector device comprises a first guide co-operating with a plurality of opposite selector rollers to select said mailpieces one-by-one and for transporting them downstream, said first guide being able to pivot about a pivot axis in opposition to first resilient return means and said first guide having a reference plate designed to co-operate with a permanent magnet that is secured to a framework of the device to prevent said first guide from pivoting in this way below a predetermined mailpiece thickness.

2. A mailpiece selector device according to claim 1, wherein said first guide has a comb structure with each of the teeth thereof being provided with an elastomer blade or with a ceramic finger.

3. A mailpiece selector device according to claim 1, further comprising a second guide mounted to pivot about said pivot axis in opposition to second resilient return means secured to said framework of the device.

4. A mailpiece selector device according to claim 3, wherein said second guide is provided with an operating lever for enabling an operator to act manually to clear the mailpiece transport path while mailpieces of large thickness, typically of thickness greater than 6 mm, are being processed.

5. A mailpiece feeder for a franking machine, which feeder includes a mailpiece selector device according to claim 1.

* * * * *